US009482388B2

(12) United States Patent
Murphy et al.

(10) Patent No.: US 9,482,388 B2
(45) Date of Patent: Nov. 1, 2016

(54) SKID-MOUNTED COMPRESSED GAS DISPENSING SYSTEMS, KITS, AND METHODS FOR USING SAME

(71) Applicant: Clean Energy, Newport Beach, CA (US)

(72) Inventors: Colm Murphy, Surrey (CA); Brad Miller, Chilliwack (CA)

(73) Assignee: Clean Energy, Newport Beach, CA (US)

( * ) Notice: Subject to any disclaimer, the term of this patent is extended or adjusted under 35 U.S.C. 154(b) by 231 days.

(21) Appl. No.: 14/076,074

(22) Filed: Nov. 8, 2013

(65) Prior Publication Data

US 2015/0129082 A1 May 14, 2015

(51) Int. Cl.
*F17C 5/06* (2006.01)
*F17C 13/08* (2006.01)

(52) U.S. Cl.
CPC ..... *F17C 5/06* (2013.01); *F17C 13/081* (2013.01); *F17C 13/083* (2013.01); *F17C 2201/054* (2013.01); *F17C 2205/0107* (2013.01); *F17C 2205/0157* (2013.01); *F17C 2221/033* (2013.01); *F17C 2223/0123* (2013.01); *F17C 2223/036* (2013.01); *F17C 2227/0157* (2013.01); *F17C 2227/0185* (2013.01); *F17C 2265/065* (2013.01); *F17C 2270/0139* (2013.01)

(58) Field of Classification Search
CPC ..... F17C 2221/033; F17C 2223/0123; F17C 2270/0139; F17C 2205/0107
USPC ..... 141/2, 4, 11, 18, 82, 231; 62/911
See application file for complete search history.

(56) References Cited

U.S. PATENT DOCUMENTS

| | | | | |
|---|---|---|---|---|
| 4,531,558 | A * | 7/1985 | Engel | B60K 15/03006 123/525 |
| 4,564,109 | A * | 1/1986 | Stavlo | B65D 19/08 206/391 |
| 7,222,647 | B2 | 5/2007 | Bingham et al. | |
| 7,967,036 | B2 | 6/2011 | Ding et al. | |
| 9,046,218 | B2 * | 6/2015 | Macaluso | F17C 5/06 |
| 2006/0118201 | A1 * | 6/2006 | Li | F17C 11/005 141/231 |
| 2009/0071565 | A1 * | 3/2009 | Ding | F17C 7/02 141/18 |
| 2013/0213521 | A1 * | 8/2013 | Isom | F17C 5/00 141/4 |

OTHER PUBLICATIONS

Jim Johnson, "Determining the proper hazardous area classification", Nov. 2008, Hydrocarbon Processing, p. 47-50.*
Patent Cooperation Treaty, International Search report for PCT/US2014/063580, Feb. 11, 2015, pp. 1-2.

* cited by examiner

*Primary Examiner* — Mark A Laurenzi
*Assistant Examiner* — Timothy P Kelly
(74) *Attorney, Agent, or Firm* — Sheppard, Mullin, Richter & Hampton LLP

(57) ABSTRACT

A skid-mounted compressed gas dispensing station comprises a skid-mounted assembly, with the skid adapted to be mounted to the ground; wherein the skid-mounted assembly comprises one or more selected from the group consisting of a dryer assembly, one or more compressors, a compressed gas storage tank, one or more dispenser assemblies, and an electrical control system, either integral to or pre-mounted on the skid.

16 Claims, 7 Drawing Sheets

SKID-MOUNTED COMPRESSED GAS DISPENSING SYSTEMS, KITS, AND METHODS FOR USING SAME

FIELD OF THE INVENTION

The invention broadly relates to compressed gas dispensing devices, systems, and kits, and methods for using the same; and, more particularly, to devices, systems, kits, and methods related to dispensing compressed natural gas ("CNG").

BACKGROUND OF THE INVENTION

Natural gas vehicles (NGVs) operate on the same basic principles as other internal combustion-powered vehicles. Fuel, in the form of natural gas, is mixed with air and fed into a cylinder where the mixture is ignited to move a piston up and down. Natural gas can power vehicles currently powered by gasoline and diesel fuels. However, at standard temperature and pressure, natural gas is a gas rather than a liquid. This gives rise to two types of NGVs: those that are configured to use compressed natural gas (CNG) and those that are configured to operate on liquid natural gas (LNG).

CNG is typically stored on-board a vehicle under high pressure (3,000-3,600 pounds per square inch) in cylindrical containers that attach to the top, rear, or undercarriage of the vehicle.

Fueling CNG vehicles occurs at CNG stations, where natural gas is typically supplied from a local gas utility line at low pressure. There are two types of fueling systems typical employed for CNG refueling: fast-fill systems and time-fill (or slow-fill) systems. Fast-fill systems typically require a large volume high-pressure storage tank system. Such systems therefore have a significantly large footprint, and require a relatively complex and costly instillation. Slow-fill systems take a longer time to refuel a vehicle compared to fast-fill systems, but do so by providing CNG to the vehicle from a compressor fed by a low-pressure gas utility line. Because slow-fill systems typically do not utilize a large volume high-pressure storage tank, they can have a much smaller footprint, thus increasing flexibility in locations available for refueling stations.

SUMMARY OF THE INVENTION

Embodiments of the present invention provide kits, systems, and methods related to skid-mounted compressed gas dispensing stations. In particular embodiments, the compressed gas may be compressed natural gas ("CNG"). Although the description below presents embodiments related to skid-mounted stations for dispensing CNG, the disclosure is not intended to be limited to CNG. As will be appreciated by one of skill in the art, the systems, kits, and methods described herein may relate to dispensing any compressed gas.

A first aspect of the invention is directed toward kits for a compressed gas dispensing station. These kits include a skid-mounted assembly, with the skid adapted to be mounted to the ground. The skid-mounted assembly comprises one or more selected from the group consisting of a dryer assembly, one or more compressors, a compressed gas storage tank, one or more dispenser assemblies, and an electrical control system, either integral to or pre-mounted on the skid. In some embodiments, the skid-mounted assembly further comprises a gas inlet. In some embodiments, the skid-mounted assembly comprises a dryer assembly. In some embodiments, the skid-mounted assembly comprises one or more compressors and an electrical assembly contained in a gas-tight enclosure.

In some embodiments, the skid-mounted assembly comprises one compressor. In some related embodiments, the skid-mounted assembly further comprises a dispenser assembly adapted to provide compressed natural gas to a receiving vessel from the compressor. In alternate related embodiments, the skid-mounted assembly further comprises a compressed gas storage tank. In further related embodiments, the skid-mounted assembly further comprises a dispenser assembly adapted to provide compressed natural gas to a receiving vessel from the compressed gas storage tank.

In further embodiments, the skid-mounted assembly comprises a plurality of compressors. In some related embodiments, the skid-mounted assembly further comprises a compressed gas storage tank, and wherein at least a first compressor is configured to feed compressed gas to said compressed gas storage tank. In some related embodiments, the skid-mounted assembly further comprises one or more dispenser assemblies, wherein the one or more dispenser assemblies, the compressed gas storage tank, and the plurality of compressors are configured so that a dispenser assembly is adapted to provide compressed natural gas to a receiving vessel from a compressor, and a dispenser assembly is configured to provide compressed natural gas to a receiving vessel from the compressed gas storage tank.

In some embodiments, the skid of the skid-mounted assembly is adapted to be mounted to one or more ground surfaces selected from the group consisting of concrete, asphalt, and crushed gravel.

A second aspect of the invention is directed toward a skid-mounted compressed gas dispensing system, comprising: a skid-mounted assembly comprising one or more selected from the group consisting of a dryer assembly, one or more compressors, a compressed gas storage tank, one or more dispenser assemblies, and an electrical control system, either integral to or pre-mounted on the skid. In some embodiments, the system further comprises a gas inlet. In some embodiments, the system comprises a dryer assembly. In some embodiments, the system comprises one or more compressors and an electrical assembly contained in a gas-tight enclosure.

In some embodiments, the system comprises one compressor. In some related embodiments, the system further comprises a dispenser assembly adapted to provide compressed natural gas to a receiving vessel from the compressor. In alternate related embodiments, the system further comprises a compressed gas storage tank. In further related embodiments, the system further comprises a dispenser assembly adapted to provide compressed natural gas to a receiving vessel from the compressed gas storage tank.

In certain embodiments, the system comprises a plurality of compressors. In some related embodiments, the system further comprises a compressed gas storage tank, and wherein at least a first compressor is configured to feed compressed gas to said compressed gas storage tank. In some related embodiments, the skid-mounted assembly further comprises one or more dispenser assemblies, wherein the one or more dispenser assemblies, the compressed gas storage tank, and the plurality of compressors are configured so that a dispenser assembly is adapted to provide compressed natural gas to a receiving vessel from a compressor, and a dispenser assembly is configured to provide compressed natural gas to a receiving vessel from the compressed gas storage tank.

A third aspect of the invention is directed toward methods for dispensing compressed natural gas from a skid-mounted compressed natural gas dispensing station. The methods comprise: feeding natural gas to a natural gas inlet of a skid-mounted dispensing station, and dispensing dried compressed natural gas from a dispenser assembly of the station. In these methods, the skid-mounted dispensing station comprises: a skid; a natural gas inlet; a dryer assembly; a first compressor configured to receive dried natural gas from the dryer assembly; an electrical control assembly located within a gas-tight enclosure; and a dispenser assembly configured to dispense compressed natural gas to a receiving vessel.

In some embodiments, the dispenser assembly is configured to receive compressed natural gas from the first compressor.

In further embodiments, the skid-mounted dispensing station further comprises a compressed gas storage tank configured to receive compressed natural gas from the first compressor. In these embodiments, the dispenser assembly is configured to receive compressed natural gas from the compressed gas storage tank.

In some embodiments, the skid-mounted dispensing station further comprises a second compressor. In some related embodiments, the skid-mounted dispensing station further comprises a compressed gas storage tank. In these embodiments, at least a first compressor is configured to feed compressed natural gas to the compressed gas storage tank. In some further related embodiments, a dispenser assembly is configured to receive compressed natural gas from the compressed gas storage tank, and a dispenser assembly is configured to receive compressed natural gas from the second compressor.

DETAILED DESCRIPTION

Figure 1A:
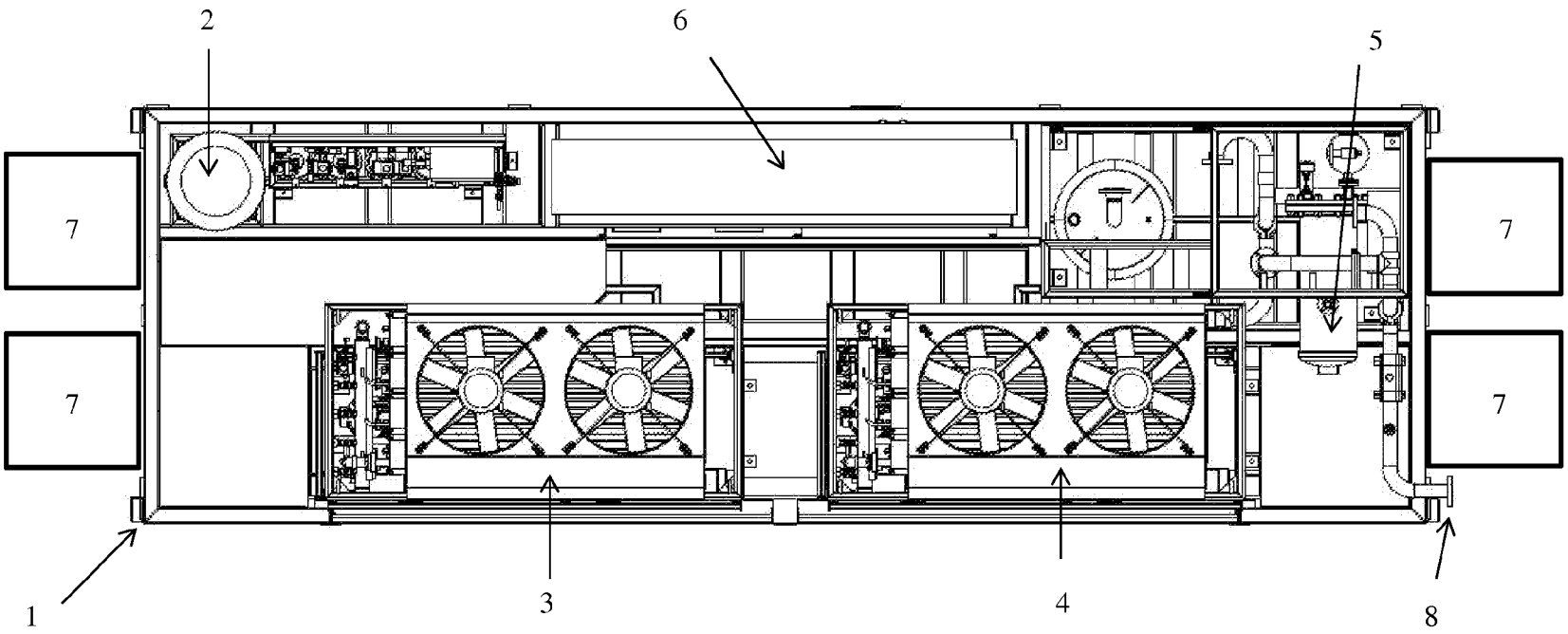
FIGS. 1A-1G show an exemplary CNG dispensing station according to one embodiment of the present invention from various angles, including from the top (FIG. 1A), from above a left side (FIG. 1B), from above a right side (FIG. 1C), from below (floor grating not shown for clarity) (FIG. 1D), from one end (FIG. 1E), from a second end (FIG. 1F), and from a right side (FIG. 1G).

In the following paragraphs, the present invention will be described in detail by way of example with reference to the attached drawings. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

As discussed above, CNG is the preferred fuel in some NGV-fleet applications. In such instances, a fleet operator may desire a CNG refueling station be present on-site for ease of refueling. However, due to the nature of the fuel, specialized equipment is required for fuel dispensing and management. Design and construction of such systems may be beyond the scope of the fleet operator. Further, local and/or national code requirements for such systems mandate certain design requirements to mitigate damage in case of catastrophic failure. Provided herein are rapid deploy modular compressed gas dispensing stations. In particular, the stations described herein may be used as CNG refueling stations. These stations are portable, self-contained compressed gas dispensing stations that may be used, e.g., to provide CNG fuel to motor vehicles in either a fast-fill or slow-fill operating mode.

The compressed gas dispensing stations described herein are self-contained, skid mounted fueling systems. In certain embodiments, an entire functional compressed gas dispensing station, including a dryer, one or more compressors, a compressed gas storage tank (e.g., a CNG storage tank), dispenser system, and electrical control system, is mounted on one or more modular assemblies that serve as a self-contained fueling station. In some embodiments, the only external connection to the assembled station that is required is a source of electrical power and a source of low pressure natural gas.

Certain embodiments comprise a skid and one or more of the following: a dryer, one or more compressors, a compressed gas storage tank (e.g., a CNG storage tank), dispenser assembly, and electrical control system. Each component will be discussed in additional detail below.

The compressed gas dispensing stations described herein comprise one or more modular assemblies. One or more of these modular assemblies comprises a skid to facilitate transport and instillation of the dispensing station at the desired location. The skid may be made of any suitable material as known in the art so long as it provides sufficient structural support for any associated station subassemblies. Further, in some embodiments, the skid may be configured to be mounted to one or more of a variety of ground surfaces (e.g., concrete/asphalt, compacted gravel, etc.), thereby providing flexibility in selection of an instillation location.

Natural gas is typically a mixture of hydrocarbon gases and liquids, including but not limited to methane, ethane, propane, butane, etc. Natural gas is usually primarily methane, but may further include higher hydrocarbons in various proportions. In addition, natural gas may further include impurities such as carbon dioxide and water vapor. When natural gas that contains water vapor is compressed in vehicle fuel tanks or other storage containers, the majority of water vapor present condenses, potentially causing blockage in CNG fueling systems, or causing corrosion in vehicle combustion systems or CNG storage vessels and piping. As such, it is often desirable to utilize a dryer subassembly which removes or reduces the amount of water vapor present in natural gas prior to storage or utilization. A dryer subassembly is most typically employed on the low pressure side of a compressor that feeds higher pressure natural gas to a storage tank or vehicle. Dryer subassemblies are well known in the art and can operate by any number of standard drying technologies, so long as the employed dryer assembly removes or reduces water vapor content in the natural gas.

As described above, CNG is dispensed from a dispensing station e.g., to a CNG vehicle, either by a fast-fill or slow-fill process. A fast-fill process generally involves filling an on-board vehicle CNG tank from a high-pressure CNG storage tank. In such systems, the high pressure CNG storage tank may be filled by a compressor fed by a low-pressure natural gas source such as a utility line. A slow-fill process generally involves filling an on-board vehicle CNG tank directly from a compressor fed by a low-pressure natural gas source such as a utility line.

Some embodiments may comprise a compressor configured so that the filling station may be operated as a slow-fill CNG station. In these embodiments, the compressor is fed at the low pressure side by a low pressure natural gas source, such as a natural gas utility line. On the high pressure side, the compressor is in fluid communication with a dispenser assembly (described in greater detail below) configured to interface with the on-board CNG fuel tanks of one or more vehicles. In such systems, a vehicle's on-board CNG fuel tank may receive CNG from the dispenser assembly via the compressor.

Some embodiments may comprise a compressor and a high pressure compressed gas storage tank (described in greater detail below) configured so that the filling station may be operated as a fast-fill CNG station. In these embodiments, the compressor is fed at the low pressure side by a low pressure natural gas source, such as a natural gas utility line. On the compressor output side, the compressor feeds CNG into the high-pressure CNG storage tank. The CNG storage tank is then in fluid communication with a dispenser assembly (described in greater detail below) configured to interface with the on-board CNG fuel tanks of one or more vehicles. In such systems, one or more vehicle's on-board CNG fuel tank may receive CNG from the dispenser assembly via the high-pressure storage tank. Fast-fill CNG stations are limited by the volume of the high-pressure compressed gas storage tank and the time it takes for a compressor to fill the tank to the necessary pressure. In such systems, the electrical control system (described in greater detail below) may comprise a pressure sensor configured monitor pressure in the high-pressure compressed gas storage tank and operate the compressor when the pressure in the tank falls below a desired level. In some embodiments, the electrical control system may be programmable to operate the compressor (and thus fill the compressed gas storage tank) during times of off-peak electrical demand.

Some embodiments may comprise a plurality of compressors, as well as a high pressure compressed gas storage tank (described in greater detail below). In some particular embodiments, a first compressor may be configured so that the filling station may operate as a slow-fill CNG station where one or more vehicles' on-board CNG fuel tank receives CNG from the dispenser assembly via the first compressor, while a second compressor and a high-pressure CNG storage tank may be configured as described above for fast-fill CNG operation, so that one or more vehicle's on-board CNG fuel tank receives CNG from the dispenser assembly via the high-pressure storage tank. Some embodiments comprising a plurality of compressors may operate concurrently as fast-fill and slow-fill dispensing stations.

In embodiments comprising a high-pressure compressed gas storage tank, the tank is capable of maintaining a volume of compressed gas at pressures typical for fast-fill CNG applications (e.g., as high as 4000-4500 psi). Such tanks are known in the art, and can be of various shapes and sizes. In some embodiments, the high-pressure compressed gas storage tank is of a size and shape that it can be mounted on a skid while remaining transportable by routine industrial means (e.g., within a standard freight container, on a flat-bed semi-truck, on a railcar, etc.). In some embodiments, the high-pressure compressed gas storage tank includes 4 ASME cylinders, each having a 42 WL (water liter) capacity (for a total of 168 WL on skid storage). In certain embodiments, the compressor fills the storage cylinders until 4500 psig is reached, and the storage cylinders are protected be a relief valve set at 5000 psig.

A compressed gas dispenser assembly provides an interface between the fueling station and a vehicle. In some embodiments, a compressed gas dispenser assembly is capable of being in fluid communication with a compressor and/or a high pressure compressed gas storage tank to dispense compressed gas to a receptacle, such as an on-board vehicle CNG tank. In some embodiments, a dispensing station may comprise a single compressed gas dispenser assembly. In alternative embodiments, a dispensing station may comprise a plurality of compressed gas dispenser assemblies. In some embodiments, one or more compressed gas dispenser assemblies are integral with or attached to the skid. In some embodiments, one or more compressed gas dispenser assemblies are present at some location not integral with or attached to the skid. In some particular embodiments, a compressed gas dispenser assembly is used to dispense CNG. Flow rates through a dispenser assembly may vary depending on the particulars of the compressed gas being dispensed. For instance, in embodiments where a dispensing station is used to dispense CNG, flow rates will vary depending whether the dispensing station is operating in fast-fill or slow-fill mode. The total flow rates can vary depending on the inlet pressure of the supply gas and which compressors are used. Using standard compressor configurations (with two 150 HP compressors running), the flow rate ranges from about 254 SCFM @ 5 psig inlet pressure to about 854 SCFM @ 150 psig inlet pressure. The flow rate from the compressor doesn't typically change with different priorities. However, the flow rates through the on skid fill modules (fast fill or time fill) and off skid dispensers and fill posts may vary depending on the pressure in the vehicle tank, how many vehicles are connected, line size and fitting restrictions and the pressure of the buffer/storage.

In some embodiments, the compressed gas dispensing station further comprises an electronic control assembly configured to control various station processes via appropriate automated valves and switches. In some embodiments, the electronic control assembly is integral with or attached to the skid. Current safety guidelines require that electrical controls must be contained within an air-tight enclosure if located within 15 feet of a compressor. Thus, in embodiments where the electronic control assembly is integral with or attached to the skid, the electronic control assembly is contained within a gas-tight enclosure.

Some embodiments optionally comprise additional subsystems or assemblies to facilitate operation of a compressed gas dispensing station. For instance, and without limitation, the compressed gas dispensing station may comprise a dispenser assembly that comprises a manifold system that allows for simultaneously dispensing compressed gas to multiple receptacles (e.g., CNG may be simultaneously dispensed to multiple vehicles at the same time through a single dispenser assembly).

Figure 1B:
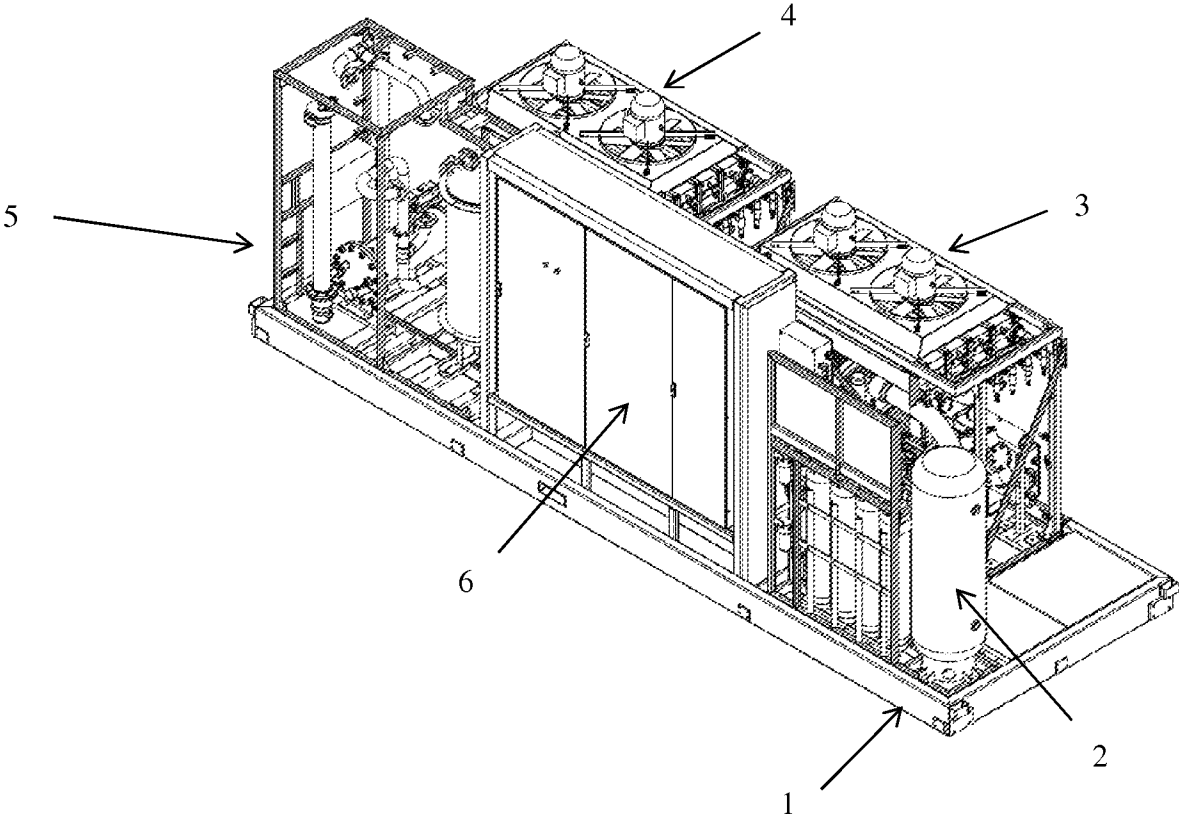
Figure 1C:
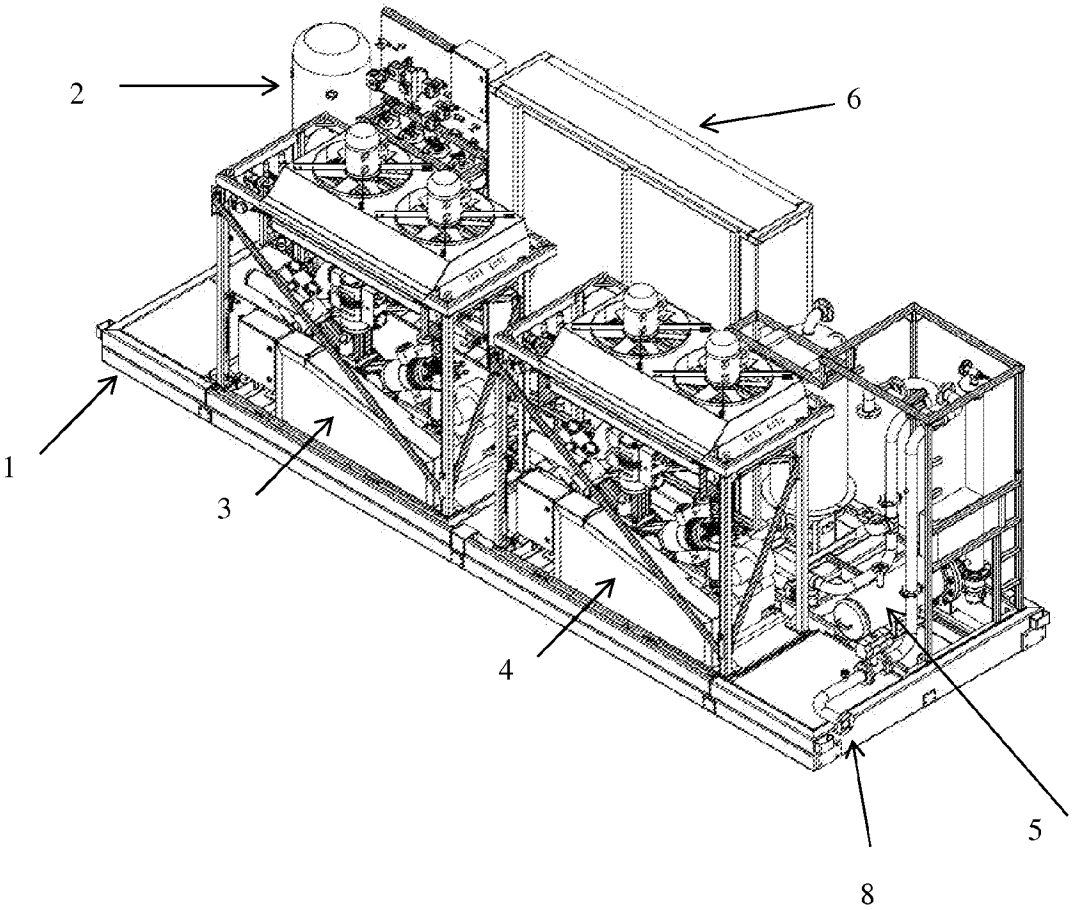
Figure 1D:
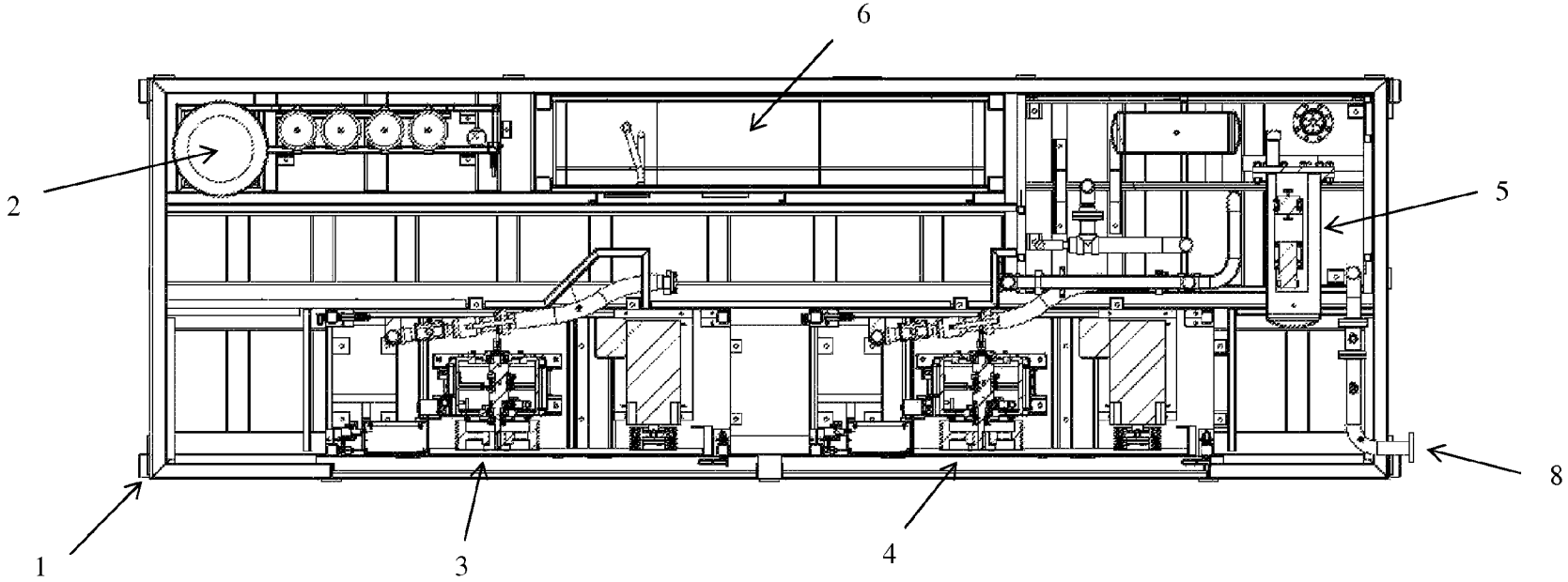
Figure 1E:
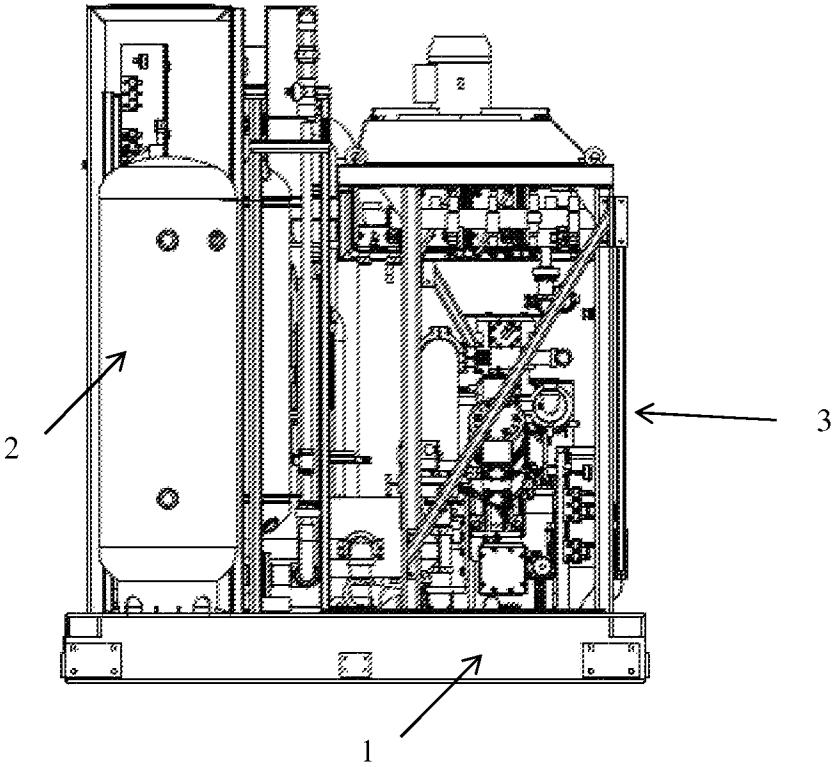
Figure 1F:
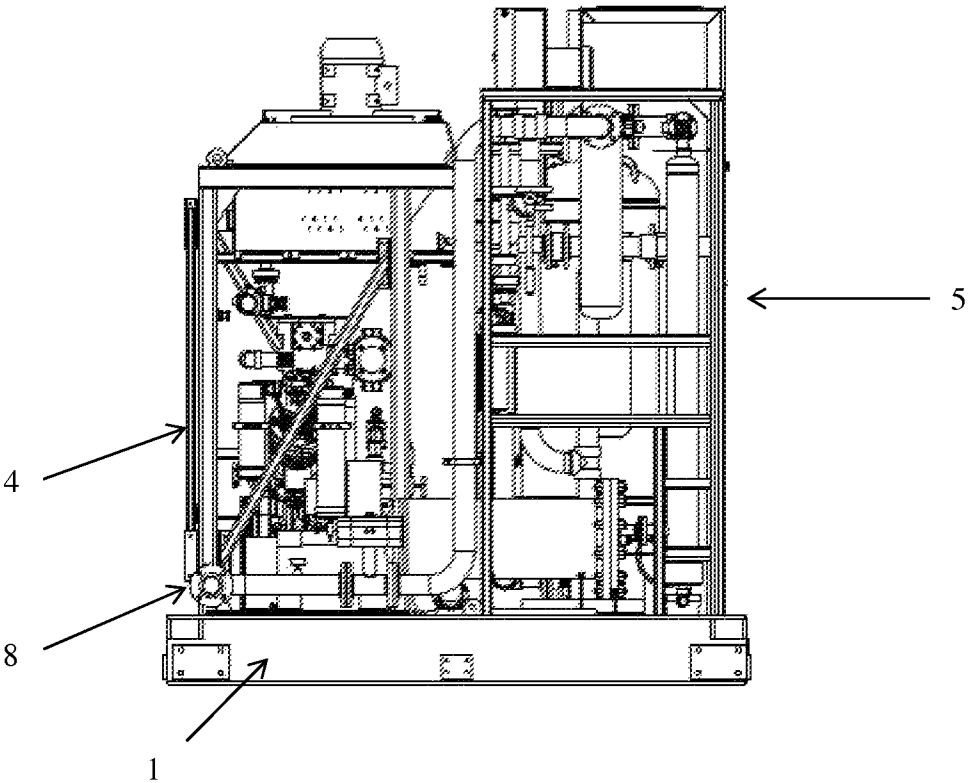
Figure 1G:
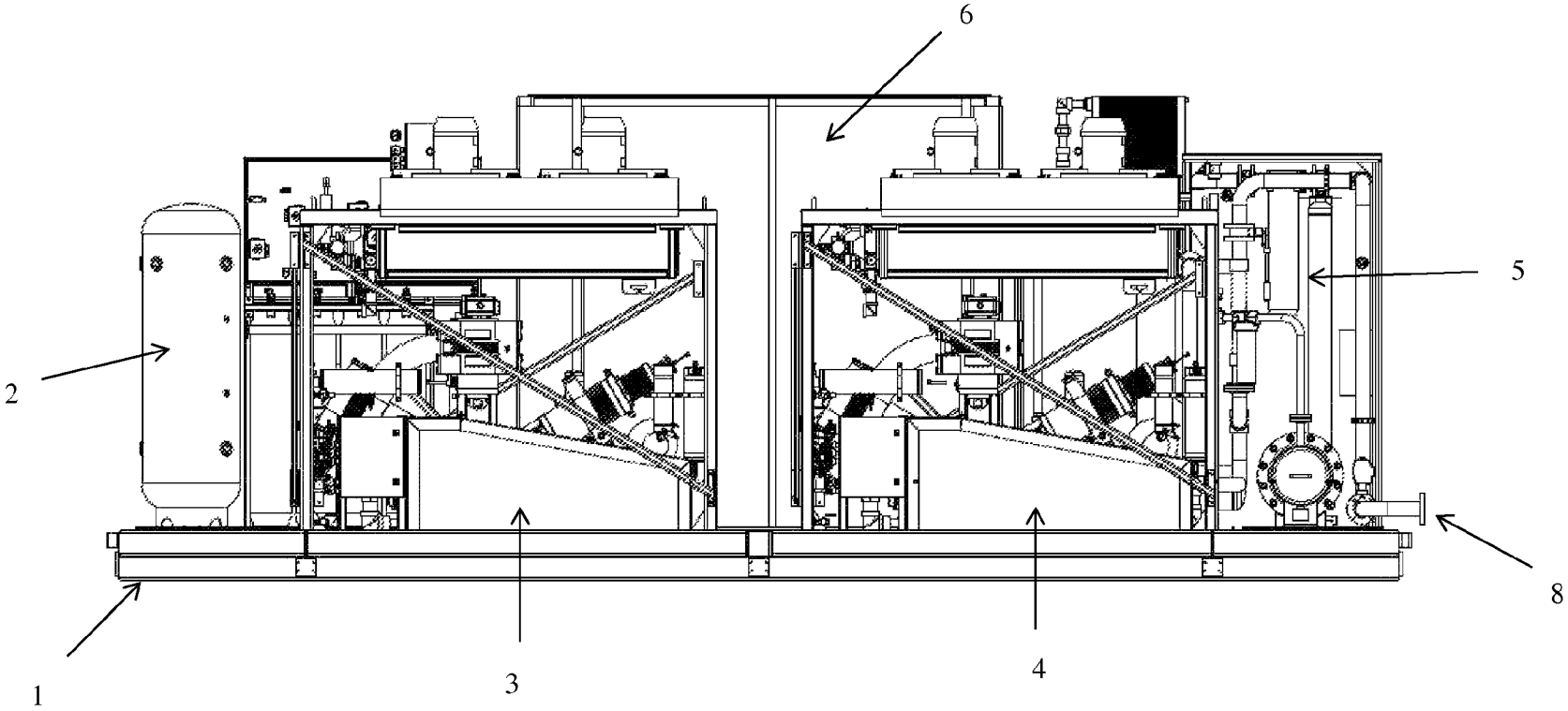

Certain compressed gas dispensing stations described herein are intended to include all subassemblies necessary for the station to be fully functional with little final assembly required at the installation site, and yet be mounted on a single skid so as to allow for ease of transport and installation. In such stations, all of the above described major subassemblies (i.e., a dryer assembly, one or more compressors, a compressed gas storage tank (e.g., a CNG storage tank), dispenser assembly, and electrical control system) may be either integrated with or pre-mounted to a single skid prior to transport and/or installation of the compressed gas dispensing station. For such an embodiment to become operational, the dispensing station would merely require delivery and placement of the skid-mounted system (i.e., the skid and integral and/or pre-mounted subassemblies), attachment of skid to the ground, and connection to a source of natural gas and a source of electricity. An example of a fully self-contained, skid-mounted dispensing station is shown in FIGS. 1A-1G.

FIG. 1 shows an exemplary CNG dispensing station according to one embodiment of the present invention. The exemplary CNG dispensing station comprises a skid 1, high-pressure compressed gas storage tank 2, a first compressor 3, a second compressor 4, a dryer 5, an electrical control assembly within a gas tight enclosure 6, and a dispenser assembly 7, and an inlet for connection to a gas source 8, such as a low-pressure utility natural gas line. FIGS. 1A-1G show the exemplary dispensing station from various angles, including from the top (FIG. 1A), from above a left side (FIG. 1B), from above a right side (FIG. 1C), from below (floor grating not shown for clarity) (FIG. 1D), from one end (FIG. 1E), from a second end (FIG. 1F), and from the right side (FIG. 1G).

The embodiment shown in these figures works as such: natural gas, e.g, from a low-pressure utility line, is introduced into the dispensing station at inlet 8. The incoming low pressure gas is initially subjected to drying at dryer assembly 5. Low-pressure gas exiting the dryer assembly then passes to first compressor 3 and/or second compressor 4. First compressor 3 pumps the gas into the high-pressure compressed gas storage tank 2 at pressures suitable for fast-fill CNG dispensing via dispensing system 7. Second compressor 4 is configured to feed dispensing system 7 directly, such that the exemplary system may be operated for slow-fill CNG dispensing via second compressor 4.

With further reference to FIG. 1, the illustrated dispensing system 7 includes 4 fill modules 7 that can be bolted onto the ends of the skid 1. In some embodiments, 3 time fill modules and 1 fast fill module are provided. In such embodiments, four off skid connections are provided, namely: dispenser, fast fill, time fill, and storage/buffer. If off skid fast fill is required, an extra priority can be added to the priority panel. In some embodiments, the customer determines the location of off skid dispensers and fill posts.

As seen in this series of Figures, it is intended that embodiments may comprise various combinations of optional features described herein, without limit.

While various embodiments of the present invention have been described above, it should be understood that they have been presented by way of example only, and not of limitation. Likewise, the various diagrams may depict an example architectural or other configuration for the invention, which is done to aid in understanding the features and functionality that may be included in the invention. The invention is not restricted to the illustrated example architectures or configurations, but the desired features may be implemented using a variety of alternative architectures and configurations. Indeed, it will be apparent to one of skill in the art how alternative functional, logical or physical partitioning and configurations may be implemented to implement the desired features of the present invention. Also, a multitude of different constituent module names other than those depicted herein may be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent.

Additionally, the various embodiments set forth herein are described in terms of exemplary block diagrams, flow charts and other illustrations. As will become apparent to one of ordinary skill in the art after reading this document, the illustrated embodiments and their various alternatives may be implemented without confinement to the illustrated examples. For example, block diagrams and their accompanying description should not be construed as mandating a particular architecture or configuration.

The invention claimed is:

1. A kit for a compressed gas dispensing station, consisting:

a skid;

a skid-mounted assembly, with the skid adapted to be mounted to a ground;

wherein the skid-mounted assembly consists of a self-contained fueling system including a dryer assembly, one or more compressors, a gas inlet, a compressed gas storage tank, one or more dispenser assemblies and an electrical control system, either integral to or pre-mounted on the skid.

2. The kit of claim 1, wherein the skid-mounted assembly is powered by an electrical assembly in contact with the electrical control system separated from the other skid components by a gas-tight barrier.

3. The kit of claim 2, wherein the dispenser assembly is adapted to provide compressed natural gas to a receiving vessel from the one or more compressors.

4. The kit of claim 2, wherein the compressed gas storage tank comprises one or more separate storage compartments.

5. The kit of claim 1, wherein the skid in the skid-mounted assembly is adapted to be mounted to one or more ground surfaces selected from the group consisting of concrete, asphalt, and crushed gravel.

6. A skid-mounted compressed gas dispensing system, consisting:

a skid;

a skid-mounted assembly consisting of a self-contained fueling system including a gas inlet, dryer assembly, one or more compressors, a compressed gas storage tank, one or more dispenser assemblies, and an electrical control system, either integral to or pre-mounted on the skid.

7. The skid-mounted compressed gas dispensing system of claim 6, wherein the system is powered by an electrical assembly in contact with the electrical control system separated from the other skid components by a gas-tight barrier.

8. The skid-mounted compressed gas dispensing system of claim 7, wherein the one or more dispenser assemblies are adapted to provide compressed natural gas to a receiving vessel from the one or more compressors.

9. The skid-mounted compressed gas dispensing system of claim 7, wherein the compressed gas storage tank comprises one or more separate storage compartments.

10. The skid-mounted compressed gas dispensing system of claim 9, wherein the dispenser assembly is adapted to provide compressed natural gas to a receiving vessel from the compressed gas storage tank.

11. The skid-mounted compressed gas dispensing system of claim 9, wherein at least the one or more compressors is configured to feed compressed gas to said compressed gas storage tank.

12. A method of dispensing compressed natural gas from a skid-mounted compressed natural gas dispensing station, the method comprising:

providing the skid-mounted dispensing station consisting of a self-contained fueling system including:

a skid;

a natural gas inlet;

a dryer assembly configured to receive natural gas from the natural gas inlet;

first and second-compressors configured to receive dried natural gas from the dryer assembly;

a compressed gas storage tank;

an electrical control assembly located within a gas-tight enclosure; and a dispenser assembly configured to dispense compressed natural gas to a receiving vessel;

feeding natural gas to the natural gas inlet of the skid-mounted dispensing station, and dispensing dried compressed natural gas from the dispenser assembly of the station, wherein the compressors are capable of pumping the gas into the compressed gas storage tank at pressures suitable for fast-fill CNG dispensing, and capable of pumping the gas directly to the dispenser assembly for slow-fill CNG dispensing.

13. The method of claim 12, wherein the dispenser assembly is configured to receive compressed natural gas from the first compressor.

14. The method of claim 12, wherein the compressed gas storage tank is configured to receive compressed natural gas from the first compressor, and wherein the dispenser assembly is configured to receive compressed natural gas from the compressed gas storage tank.

15. The method of claim 14, wherein at least the first compressor is configured to feed compressed natural gas to said compressed gas storage tank.

16. The method of claim 15, wherein the dispenser assembly is configured to receive compressed natural gas from the compressed gas storage tank; and wherein the dispenser assembly is configured to receive compressed natural gas from the second compressor.

* * * * *